United States Patent [19]

Goodall

[11] 4,142,301

[45] Mar. 6, 1979

[54] METHOD AND APPARATUS FOR DRYING PHOTOGRAPHIC MATERIAL

[75] Inventor: Charles C. O. Goodall, Ilford, England

[73] Assignee: Ciba-Geigy AG, Basel, Switzerland

[21] Appl. No.: 842,634

[22] Filed: Oct. 17, 1977

[30] Foreign Application Priority Data

Oct. 20, 1976 [GB] United Kingdom ..... 43494/76

[51] Int. Cl.[2] ..... F26B 7/00; F26B 13/00

[52] U.S. Cl. ..... 34/18; 34/23; 34/41; 34/60; 34/151; 34/155; 34/162

[58] Field of Search ..... 34/4, 17, 39, 60, 145, 34/151, 155, 162, 18, 23, 41

[56] References Cited

U.S. PATENT DOCUMENTS

| | | | |
|---|---|---|---|
| 3,158,447 | 11/1964 | Sable | 34/151 X |
| 3,387,386 | 6/1968 | Gaubatz | 34/145 |
| 3,800,432 | 4/1974 | Miyata et al. | 34/151 |
| 3,863,360 | 2/1975 | Stievenar | 34/155 |

FOREIGN PATENT DOCUMENTS

| | | | |
|---|---|---|---|
| 2221987 | 10/1974 | France | 34/151 |

*Primary Examiner*—Leland A. Sebastian
*Attorney, Agent, or Firm*—Harry Falber

[57] ABSTRACT

A method of drying processed polyethylene coated photographic paper in an enclosed drying chamber through which the exposed and processed polyethylene coated photographic paper bearing an image on one side of its sides is made to travel.

This comprises directing radiant heat onto the non-image bearing side only of the paper as it travels through the drying chamber and as a stream of air flows over the image bearing side of the photographic paper.

The advantage of this invention over drying apparatus at present commercially available is that less heat energy is required to dry large photographic sheets.

12 Claims, 2 Drawing Figures

METHOD AND APPARATUS FOR DRYING PHOTOGRAPHIC MATERIAL

Figure 1:
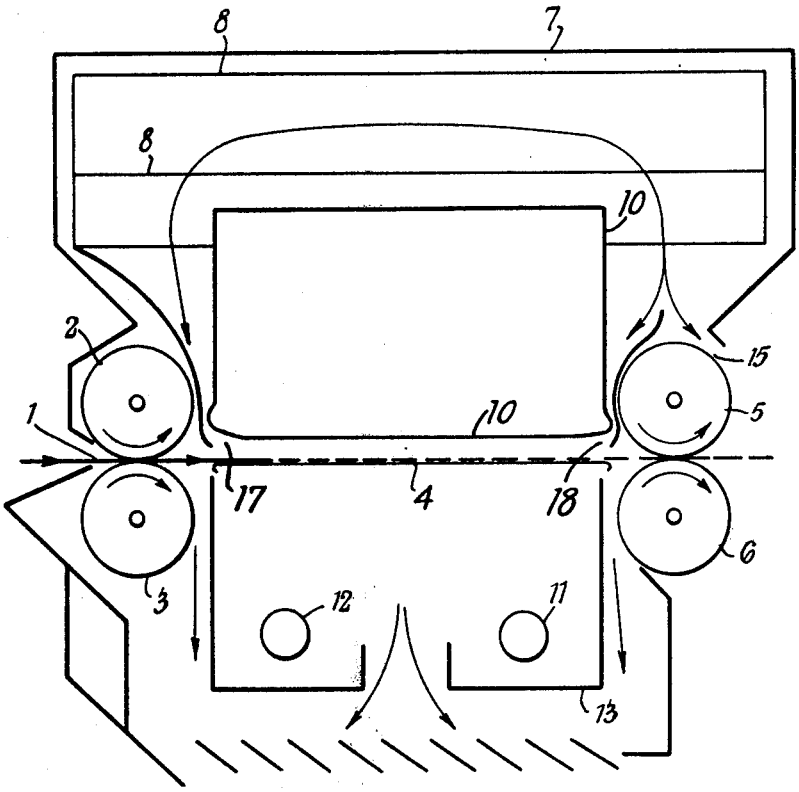

This invention relates to a method of drying photographic paper in sheet form and to an apparatus for carrying out the method.

One form of photographic paper in sheet form which recently has come into common use is paper base covered on each side with a thin layer of polyethylene there being coated on one polyethylene layer a layer of photographic emulsion. It is possible using controlled conditions to produce a gloss on the image (or emulsion) side of the photographic paper of this type without having to use a glazer. However care must be taken to prevent the paper curling badly and also taking on a milky appearance in the dark areas of the image. This milky appearance or bloom is thought to be caused by an uneveness in the surface of the binder of the emulsion (usually gelatin) caused by the drying.

There is described in British patent specification Ser. No. 1,369,298 a method of drying processed photographic paper material in sheet form and in particular polyethylene laminated photographic paper material by use of which a gloss can be produced on the image surface of the material and the defects of curl and milkiness minimised and also apparatus for carrying out the method.

In. Ser. No. 1,369,298 there is described a method of drying photographic paper in an enclosed drying chamber through which the exposed and processed photographic paper bearing a photographic image on one side thereof is caused to travel, which comprises directing radiant heat on to both sides of the photographic paper as it is caused to travel through the drying chamber and simultaneously causing a stream of cool air to flow over the image side of the photographic paper.

The apparatus described in Ser. No. 1,369,298 has proved to be very successful commercially. However when an apparatus of this type was prepared which could take wide sheets of photographic paper that is to say sheets at least 20 inches wide, it was found that a great deal of energy was required to dry the sheet. Experiments were then carried out in an effort to reduce the number of radiant heaters and very surprisingly it was discovered that radiant heat need only be applied to the non-image side of the sheet of photographic paper.

Therefore according to the present invention there is provided a method of drying processed polyethylene coated photographic paper in an enclosed drying chamber through which the exposed and processed polyethylene coated photographic paper bearing an image on one side thereof is caused to travel, which comprises directing radiant heat on to the non-image-bearing side of the paper as it is caused to travel through the drying chamber and simultaneously causing a stream of air to flow over the image-bearing side of the photographic paper.

The air which is caused to flow over the image-bearing side of the processed polyethylene coated paper whilst the non-image bearing side is subjected to radiant heat is preferably cool air and most preferably between 20° to 40° C. but it may be warm air that is to say air between 50° to 80° C. It is probable that the main function of the air in the method of the present invention is to remove from the apparatus all the water vapour driven out of the photographic material by the radiant heat.

According to another aspect of the present invention there is provided an apparatus for drying polyethylene coated photographic paper by the method as just set forth which comprises an enclosed drying chamber having an open support therein for supporting the photographic paper in its passage through the drying chamber, a source of radiant heat located on the side of the support remote from the side which supports the photographic paper, together with means for directing the radiant heat on to the under side of the open support, and means for causing at least one stream of air to flow downwards towards the topside of the support, and at least one pair of nip rollers for driving the photographic paper into the apparatus and a pair of nip rollers for driving the photographic paper out of the apparatus.

Preferably in this apparatus at least one stream of cool air is caused to flow downwards towards the top side of the support and at least one stream of cool air is caused to flow over the output pair of nip rollers.

The method and apparatus of the present invention may be used both for cut sheets of photographic paper and for paper in roll form.

Preferably in this apparatus the stream of cool air which flows over the output pair of nip rollers also impinges on the photographic paper as it emerges from the apparatus. This helps to prevent the paper curling.

Preferably the pair of nip rollers for driving the photographic paper out of the apparatus are covered with a foamed plastics material, for example foamed neoprene. It has been found that foamed plastics material does not mark the photograhic paper to any great extent.

By open support is meant a support through which radiant heat can be directed. Examples of open supports are wire mesh or thin metal strips or wires formed into a support.

The preferred source of radiant heat is a radiant heater of the bar type. The preferred means for directing the radiant heat is a metal reflector.

Preferably there is located in the apparatus on the side of the support which does not support the sheets of photographic paper two bar radiant heaters together with metal reflectors to direct the radiant heat on to the reverse side, i.e., non-image-bearing sides of the photographic paper through the open support.

Because the method and apparatus of this invention is particularly adapted to the processing of wide (i.e., over 20 inch) sheets of photographic paper a modified arrangement for producing the streams of cool air is preferred to the arrangement described in Ser. No. 1,369,298. In this modified arrangement a curtain of cool air is directed down on to the sheet of paper above the line over which its leading edge reaches the open support and this air is then directed forwards to flow over the image-bearing side of the photographic paper whilst it is supported on the open support and a curtain of cool air is directed down on to the sheet of paper above the line over which its leading edge leaves the open support and this air is then directed backwards to flow over the image-bearing side of the photographic paper whilst it is supported on the open support.

These two air curtains help to retain the processed sheet of paper on the open support whilst the paper is being traversed through the drying chamber. Also this arrangement helps to ensure an even distribution of cool air streams over the entire width of the paper whilst its non-image side is being heated by infrared radiation.

The cool air is preferably provided by a turbo-fan and the temperature of the cool air is preferably between 20° to 40° C.

Thus preferably the apparatus of the present invention comprises a slot located above the entry side of the open support and a slot located above the exit side of the open support, the slots being so shaped as to cause air passing therethrough to be directed over the said open support.

In another embodiment further streams of air are provided in the apparatus between the two curtains of air produced from the two slots located at the entry and exit sides of the drying chamber.

Preferably the pair or pairs of nip rollers which serve to drive the photographic paper into the apparatus are squeegee rollers for example one or more pairs comprising a solid neoprene roller and a closed-cell neoprene roller. The squeegee rollers remove excess water from the surface of the photographic paper when they come straight from a wash bath. Preferably there are two such pairs of squeegee rollers.

It is to be understood that the minimum size of sheets of photographic paper which can be used in the apparatus depends on the distance between the nip rollers which drive the sheets into the apparatus and the nip rollers which drive the sheets out of the apparatus. One or other or both of these pairs of nip rollers must be acting on a sheet at one time while it is in the apparatus.

By use of the method of the present invention and especially when the amount of radiant heat to which the exposed photographic material is controlled and the length of time which the paper is present in the apparatus is also controlled it is possible to produce sheets of processed polyethylene coated photographic paper which are substantially dry, have a good gloss and minimal curl. Also it is possible to produce processed sheets wherein the darkest areas of the image exhibit substantially no milkiness nor bloom.

The following drawings will serve to illustrate one embodiment of an apparatus of the present invention which employs the method of the present invention.

The FIG. 1 is a cross sectional side elevation of an apparatus which employs the method of the present invention.

Figure 2:
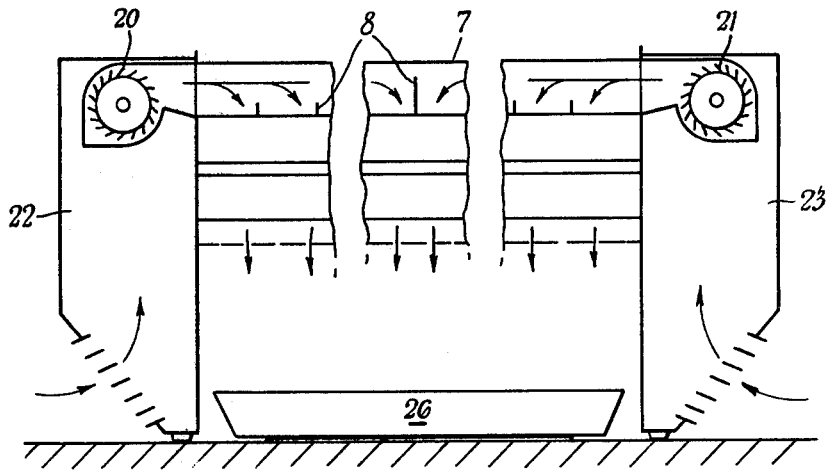

FIG. 2 is a cross sectional front elevation of the apparatus shown in FIG. 1.

In FIG. 1 a cut sheet of photographic paper 1 is shown entering the apparatus. It is driven into the apparatus by means of a pair of rubber-covered nip rollers 2 and 3, on to the open support 4 which comprises a network of metal wires. The open support 4 extends across the length of the apparatus to a pair of foamed neoprene covered-rollers 5 and 6. (The directions in which the rollers rotate are indicated by the arrows thereon). The apparatus is enclosed in a cover 7 and inside the cover 7 are air baffles 8 and 10. Located below the support 4 are two bar radiant heaters 11 and 12. Heat from these radiant heaters is directed on to the underside of the support 4 by a reflector 13. Above the support 4 is an air baffle 10. Cool air is blown into the space above the baffle 10 by two turbo fans (not shown) located at each side of the apparatus. Air is directed by the baffles through slot 17 located at the entry side of the apparatus and through slot 18 located at the exit side of the apparatus onto the support 4.

In FIG. 2, two turbo-fans 20 and 21 are in end boxes 22 and 23 which are attached to the cover 7 of the dryer. The direction of the air flow produced by these turbo fans 20 and 21 is indicated by the arrows in FIGS. 1 and 2. Cool air first strikes the photographic paper as it emerges from the driven nip rollers 2 and 3 and flows over its surface.

In operation the heaters 11 and 12 are turned on and air from the turbo fans is directed through the slots. A cut sheet of photographic paper is removed from the washing dish 26 which is located under the apparatus and is then fed into the apparatus with the image or emulsion surface upwards through the nip of the rollers 2 and 3. These rollers remove excess moisture from the paper and drive the paper on to the support 4 and it is then acted on by a curtain of cool air from the slot 17. Then as it comes over the reflector 13 radiant heat is directed on to the underneath surface of the sheet of paper from the radiant heaters. The sheet of paper is traversed by the nip rollers 2 and 3 through the apparatus over the support 4 until it reaches the nip of the rollers 5 and 6 which drive it out of the apparatus. A curtain of cool air from slot 18 is directed on to the sheet just before it reaches the pair of nip rollers 5 and 6. Thus the streams of cool air pass over the surface only of the photographic paper during the time radiant heat is reflected on to its non-image side and remove the water vapour expelled from the photographic material by the radiant heat. A stream of cool air cools the rollers 3,5 and 6. As the sheet of paper emerges from the rollers 5 and 6 a stream of cool air impinges on it through the gap 15 between the casing and the nip roller 5.

In one test a sheet of exposed and processed polyethylene coated photographic paper of the type in which the finished print should be glossy which comprised a developed gelatino silver halide emulsion coated on polyethylene coated paper base was dried in an apparatus as shown in the Figures. The pairs of nip rollers 2 and 3 and 5 and 6 were 11.5 cms apart. The distance apart of fan 20 from fan 21 was 46 cms.

Two radiant heaters each of 600 watts were employed, and the paper was transported at a speed of about 1 cm/sec. The material when received out of the drying apparatus was substantially dry and flat and had very little tendency to curl. The print exhibited a high gloss and the dark areas of the image exhibited no milkiness.

What I claim is:

1. A method of drying processed polyethylene coated photographic paper in an enclosed drying chamber through which the exposed and processed polyethylene coated photographic paper bearing an image on one side thereof is caused to travel, which comprises directing radiant heat on the non-image-bearing side of the paper as it is caused to travel through the drying chamber and simultaneously causing a stream of air to flow over the image-bearing side of the photographic paper.

2. A method according to claim 1 wherein the temperature of the stream of air is from 20° to 40° C.

3. An apparatus for drying polyethylene coated photographic paper which comprises an enclosed drying chamber having an open support therein for supporting the photographic paper in its passage through the drying chamber, a source of radiant heat located solely on the side of the support remote from the side which supports the photographic paper, together with means for directing the radiant heat on to the under side of the open support, and means for causing at least one stream of cool air to flow downwards towards the topside of the support, and at least one pair of nip rollers for driving the photographic paper into the apparatus and a pair of nip rollers for driving the photographic paper out of the apparatus.

4. An apparatus according to claim 3 further comprising means which cause at least one stream of cool air to flow over the output pair of nip rollers.

5. An apparatus according to claim 4 wherein the stream of cool air which flows over the output pair of nip rollers also impinges on the photographic paper as it emerges from the apparatus.

6. An apparatus according to claim 3 wherein the pair of nip rollers for driving the photographic paper out of the apparatus are covered with a foamed plastics material.

7. An apparatus according to claim 3 wherein the source of radiant heat is a radiant heater of the bar type.

8. A apparatus according to claim 7 wherein there is located in the apparatus on the side of the support which does not support the sheets of photographic paper two bar radiant heaters together with metal reflectors to direct the radiant heat on to the reverse side, i.e., non-image-bearing sides of the photographic paper through the open support.

9. An apparatus according to claim 3 comprising means for directing a curtain of cool air down on to the photographic paper above the line over which its leading edge reaches the open support, and for directing this air then forwards to flow over the image-bearing side of the photographic paper while it is supported on the open support, and means for directing a curtain of cool air down on to the sheet of paper above the line over which its leading edge leaves the open support and for directing this air then backwards to flow over the image-bearing side of the photographic paper while it is supported on the open support.

10. An apparatus according to claim 3 wherein the air is at a temperature of 20° to 40° C. and is provided by a turbo-fan.

11. An apparatus according to claim 9 comprising a slot located above the entry side of the open support and a slot located above the exit side of the open support, the slots being so shaped as to cause air passing there-through to be directed over the said open support.

12. An apparatus according to claim 3 wherein said at least one pair of nip rollers which serve to drive the photographic paper into the apparatus are squeegee rollers.

* * * * *